United States Patent [19]

Hartmann

[11] Patent Number: 4,961,439

[45] Date of Patent: Oct. 9, 1990

[54] HAIR STREAKING APPARATUS

[76] Inventor: Judy Hartmann, Rte. 2, Box 935 "P", Reserve, La. 70084

[21] Appl. No.: 285,669

[22] Filed: Dec. 16, 1988

[51] Int. Cl.[5] ..... A45D 7/02

[52] U.S. Cl. ..... 132/212; 132/270

[58] Field of Search ..... 132/208, 212, 270; 43/53.5; 66/117, 118, 119

[56] References Cited

U.S. PATENT DOCUMENTS

| | | | |
|---|---|---|---|
| 2,655,924 | 10/1953 | Petitta | 132/212 |
| 3,588,078 | 6/1971 | Van De Sande | 269/6 |
| 4,020,854 | 5/1977 | Caruso | 132/208 |
| 4,267,850 | 5/1981 | Barrett | 132/270 |
| 4,509,538 | 4/1985 | Ramik | 132/212 |

*Primary Examiner*—John J. Wilson
*Assistant Examiner*—Frank A. LaViola, Jr.
*Attorney, Agent, or Firm*—Pravel, Gambrell, Hewitt, Kimball & Krieger

[57] ABSTRACT

A streaking pin, having an elongated body portion, with the lower end having a hook for hooking strands of hair during the streaking process. The body portion of the pin would be housed within an elongated housing, the housing having a pair of spring members, accommodating the pin through the coils of the spring, with the lower spring member positioned so as to allow the extending of the lower portion of the pin out of the housing during the pulling of the hair, and with the upper spring member for allowing retraction of the pin partially into the housing should the end of the pin make contact with the scalp or the like. The apparatus would further include a cap member for enclosing the exposed hook portion of the pin when the apparatus is not in use.

10 Claims, 3 Drawing Sheets

HAIR STREAKING APPARATUS

BACKGROUND OF THE INVENTION

1. Field of the Invention

The apparatus of the present invention relates to hair products, more particularly the present invention relates to an apparatus comprising a hair streaking pin positioned within a housing, so that hook portion of the pin extends out from the housing with the pin being spring loaded so as to allow ease of use in pulling hair during the streaking process.

2. General Background

In the area of hair care and hair coloring, one of the most common treatment of hair which is done at the present time, is the process of streaking hair so that certain strands of hair are highlighted a different color, and provide highlights in one's hair. The manner in which this technique is carried out is that the hair is usually encased in a flexible skull cap, where skull cap includes a plurality of ports so that strands of hair may be pulled through the ports and colored a different color in order to produce the colored highlights. The manner in which the hair is pulled through the ports would usually include a pin, which would have a hook portion on its end, so that the pin is inserted into each one of the ports, a group of strands of hair is hooked by the hook portion and the hair is pulled through the ports in the skull cap. One of the drawbacks of this particular process is the fact that there is no manner in which one can gauge how deep the pin in going into the port of the cap, which often results in the hook on the end of the pin making contact with the scalp which may cause pain or even puncture one's scalp during use. In addition, because the pin is a single metal or plastic rod, when the hair is pulled from the port, there is no "give" in the pulling, which often results in a painful pulling of the hair as the hair is pulled out of the cap in order to be treated.

There is therefore a need in the art for an improved type of hair streaking pin, which may solve some of the problems that are confronted heretofore. A search of the art, for patents which may address this particular subject matter, was undertaken, with the following patents to be the most pertinent:

| PATENT NO. | TITLE | PATENTEE |
|---|---|---|
| 3,477,446 | HAIR-TREATING METHOD AND APPARATUS | TERRENZIO |
| 2,818,074 | HAIR AND SCALP PROTECTORS | MACH |
| 3,390,689 | ARRANGEMENT FOR TREATING HAIR | NEWMAN |
| 3,588,078 | HOLDER FOR FISHHOOKS AND OTHER SMALL COMPONENTS | VAN DE SANDE |
| 2,795,887 | FISH HOOK EXTRACTOR | LOCKERT |
| 4,590,702 | FISHHOOK REMOVING TOOL | CHESTNUTT |
| 2,688,816 | FISHHOOK REMOVER | BONDESEN |
| 3,451,157 | FISHHOOK REMOVER | JONES |

SUMMARY OF THE PRESENT INVENTION

The apparatus of the present invention solves the problems in the art in a simple and straightforward manner. What is provided is a streaking pin, having an elongated body portion, with the lower end having a hook for hooking strands of hair during the streaking process. The body portion of the pin would be housed within an elongated housing, the housing having a pair of spring members, accommodating the pin through the coils of the spring, with the lower spring member positioned so as to allow the extending of the lower portion of the pin out of the housing during the pulling of the hair, and with the upper spring member for allowing retraction of the pin partially into the housing should the end of the pin make contact with the scalp or the like. The apparatus would further include a cap member for enclosing the exposed hook portion of the pin when the apparatus is not in use.

Therefore, it is the principal object of the present invention to provide a composite hair streaking pin apparatus, which provides for a streaking pin positioned within a housing around the pin for use;

It is still a further object of the present invention to provide a streaking pin within a housing so that the end of the pin may be retracted and extended from the housing against the bias of the spring and the housing for preventing housing injury or pain to the customer; and It is still a further object of the present invention to provide an improved streaking apparatus which would for the most part be contained within an overall housing, but would allow use of the streaking pin in a manner that would protect the person upon it is being used and would reduce pain in its use.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
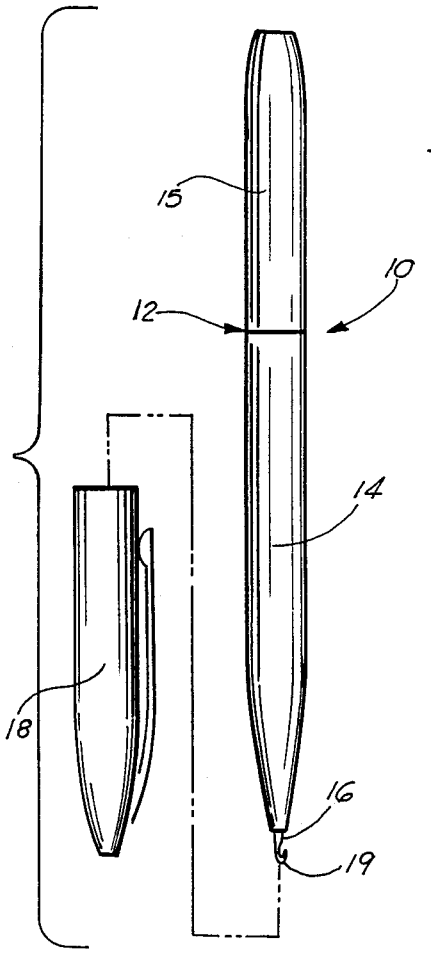
FIG. 1 illustrates an overall view of the composite hair streaking pin of the apparatus of the present invention.

The apparatus of the present invention is illustrated in FIG. 1 by the numeral 10. As illustrated in FIG. 1, overall apparatus 10 would include an overall housing 12 which would include a lower housing portion 14, an upper housing portion 15, a streaking pin 16 (only partially illustrated), and a lower cap member 18 which would be positioned over the lower end 19 of pin 16 while the apparatus is not in use.

Figure 2:
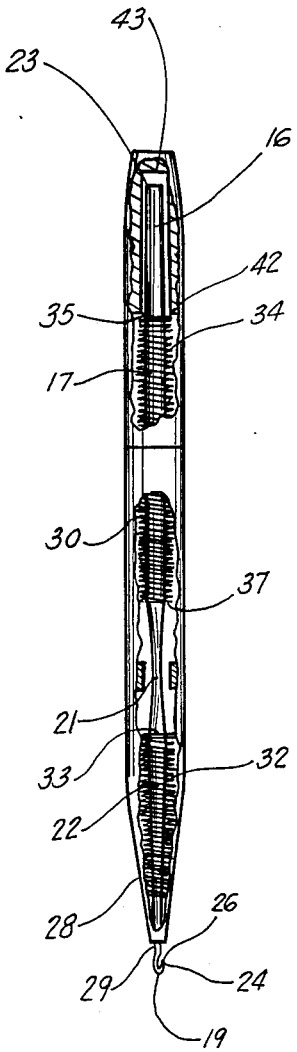
FIG. 2 is a cutaway view of the hair streaking pin of the apparatus of the present invention.
Figures 7, 8:
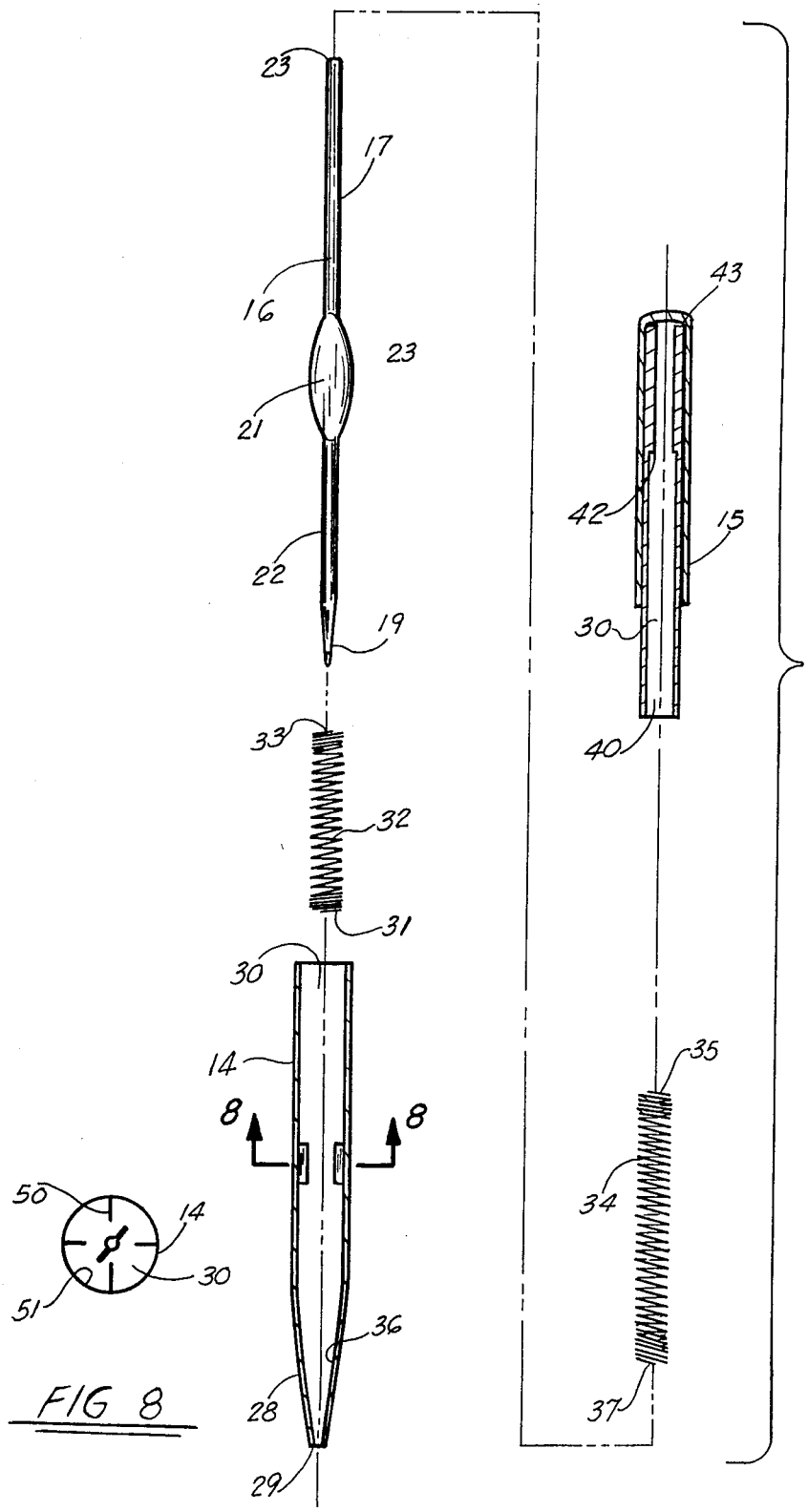
FIG. 7 illustrates an exploded view of the hair streaking pin of the apparatus of the present invention.
FIG. 8 illustrates a view along lines 8—8 in FIG. 7 of a rotating stop means in the apparatus of the present invention.

Turning now to the construction of the apparatus, reference is made to FIGS. 2 and 7. As seen in the FIGURES, the apparatus would include overall a streaking pin 16 which is of the type having an upper cylindrical body portion 17, a flared central body portion 21, and a lower cylindrical body portion 22, with a lower hook portion 19 on its end, with a hook portion including a hook 24 in a hair receiving space 26 formed by the upper depending hook 24. For purposes of size, streaking pin would for the most part be approximately 5 to 7 inches long, and would be of a diameter that one would normally comfortably hold in one's hand. As illustrated in the FIGURES, streaking pin 16 would be placed within a housing 12 with the upper portion of housing 12 being designated as 15, and the lower portion of housing 12 being designated as 14. A lower housing 14 would include a tapered lower end portion 28, which would provide a lower port 29 of sufficient diameter to allow end portion 19 of pin 16 to extend therefrom as seen in FIGS. 1 and 2. Further, housing 14 would provide an interior continuous bore 30, of a diameter sufficient to accommodate pin 16, and a pair of spring members 32 and 34. First spring member 32 would be a helical type spring having a central bore 33 therethrough, the central bore 33 of a sufficient diameter to accommodate the lower body portion of pin member 16 therethrough, to be positioned as seen in FIG. 2. The lower end 31 of spring 32 would make contact with the interior tapered wall 36 of housing 14, and would be prevented from going any further into housing 14 as is illustrated in FIG. 2, and the upper end of 33 of spring 32 would make contact with the lower ball of flared portion 21, so therefore spring 32 when pin member is positioned within 30 of housing 14 would be accommodated between the flared portion 21 of pin 16 and the lower tapered wall 36 of tapered end 28 of housing 14.

Due to the overall length of lower portion 22 of pin 16, when the spring is in the fully extended position as seen in FIG. 2, the body portion 22 of pin 16 is of sufficient length so that the end 19 of pin 16 would extend out from the lower tip 29 of housing 14 as illustrated in FIGS. 1 and 2.

After pin 16 has been positioned within housing 14 as illustrated in FIG. 2, a second spring member 34 having an upper end portion 35 and a lower end portion 37, and of the similar diameter of spring 32 would be positioned over the upper body portion 17 of pin 16, with a lower end 37 of spring 34 making contact with the flared wall of flared portion 21, so that spring member 34 could only extend down to the flared portion 21 as is illustrated in FIG. 2. Following the positioning of spring member 34 onto the upper body portion 17 of pin 16, the upper cap member 15 would be slideably engaged upon the pin in order to form the composite housing 12, as illustrate in FIG. 1.

Likewise upper housing 15 would likewise include a central bore 40, of sufficient diameter to accommodate the body portion 17 of pin 16 with spring 34 positioned therearound, with the upper end portion 35 engaging an internal shoulder portion 42 within upper housing 15, so that upper spring member 34 would then extend between the shoulder portion 42 within housing 15 to its lower end engaged against the wall of flared central portion 21 of pin 16, when the pin is ready for use. At the upper portion of housing 15, within bore 30, there is provided internal stops 43, so that the upper end 23 of pin 16 makes contact with stop 43 so that hook 19 does not move into housing 12 during use.

It should be noted that further included in the lower body portion 14 of the housing 12, is a means for preventing pin member 16 from rotating within housing 12 during use. This means for preventing rotating would utilize a plurality of stop members 50 extending outwardly from the interior wall 51 of housing 14, as illustrated in FIG. 8, at a point which is level with the position of flared portion 21 while pin member 16 is within housing 12. As is illustrated, each of the stop members 50 extend inwardly into the bore 30 of housing 14 sufficient to make contact with the flared edge 23 of flared portion 21, and therefore prevent any further rotation of the pin member within the housing when the flared edge 23 makes contact with the stops 50 during use. This would prevent any problem with the pin spinning around within the housing in an attempt for the usage of grabbing strands of hair.

Figure 3:
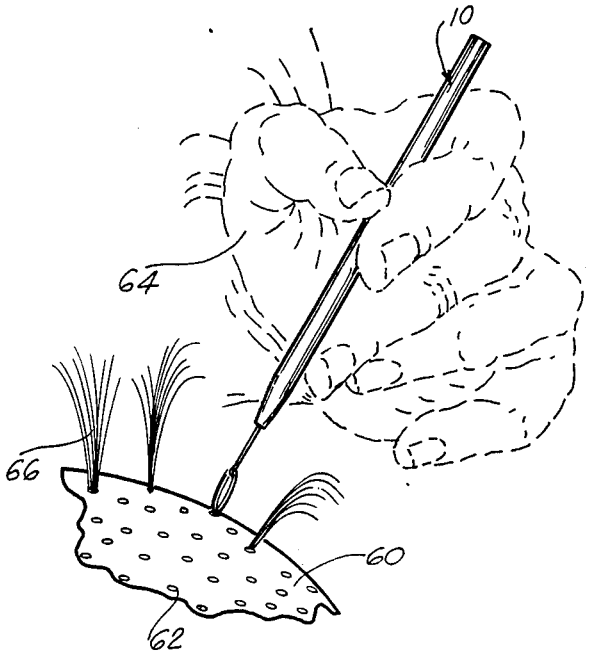
FIG. 3 is a view of the hair streaking pin of the apparatus during use.
Figure 4:
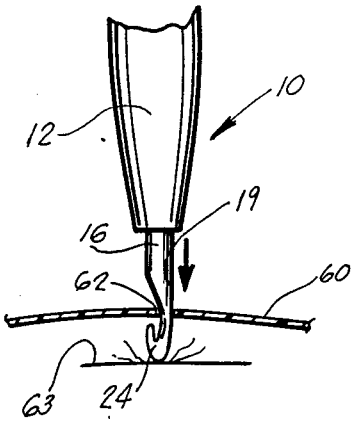
FIGS. 4, 5, & 6 illustrate in detail view the hair streaking pin of the apparatus of the present invention operating during use.
Figure 5:
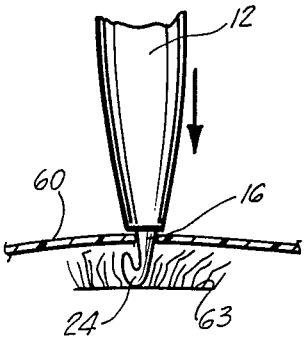
Figure 6:
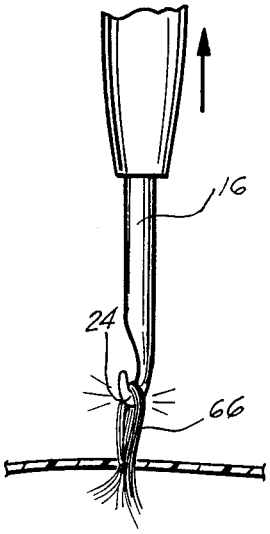

Turning now to the use of the apparatus reference was made to FIGS. 3–6. As seen in FIG. 3, there is illustrated a skull cap 60, having a plurality of holes 62, wherein the pin 10 is being held by a hand 64, and is pulling a plurality of strands of hair 66 through the ports 62, during use. This would be the standard way in which the streaking pin apparatus would be utilized. However, as seen in FIGS. 4, 5, & 6, the specific advantages of the streaking pin are easily identified. As seen in FIG. 4 there is illustrated the streaking pin 10 being lowered into a port 62 in cap 60, wherein the end 19 of pin 16 has made contact with a person's scalp 63. In the present state of the art, should this occur with a streaking pin in one's hand, it is possible that the hook 24 in 16 would make sufficient art contact with scalp 62 which would cause a break of the scalp and of course bleeding and pain. However, due to the presence of the housing 12 around pin 16, with pin 16 spring loaded via springs 32 and 34 therein, one must turn now to FIG. 5. In FIG. 5 it is illustrated that when the hook 24 of pin member 16 has made contact with scalp 63, the housing 12 which is grasped by the user as illustrated in FIG. 3 would continue to move downward against the bias of lower spring 32, which would relieve the force off of the pin 16 and therefore would not injure or hurt the user. As illustrated in FIG. 5 the housing 12 has moved from its normal up position when spring 32 is fully extended to its down position almost making contact with the skull cap 60, against the bias of lower spring 32. Of course this transfer of force would relieve pressure off the scalp, the spring 32 would then return to its normal extension, and the function of the pin by pulling the hair could be accomplished.

In FIG. 6 there is illustrated the second important part of the present invention of any pain to the user. As was stated earlier, once strands of hair have been grasped by the hook 24 of pin 16 in the present state of the art the pin 16 simply puts a direct pull on the hair, and there is no possibility of give or biasing of the pin due to the direct contact between the user and the pin itself. However, with the present invention, since the user is grasping the apparatus by the housing, a pull is being made on the hair as illustrated in FIG. 6, upper spring 34 would allow the housing of lower spring 32, would be biased and compressed as the housing would be pulled up, yet the pin 16 would be allowed to maintain itself in relative non-movement, therefore transferring a great deal of the pulling force directly from the pin into the bias spring. After the spring has been biased, and the user can feel the pulling against the biasing of the spring, the pulling can be eased off so that the hair is pulled from the cap, against the bias of the spring. After the pulling of the hair is completed, the spring is to reextend back to its normal position and pulling of additional hair can be undertaken.

Therefore, with the use of the upper and lower springs in combination with a pin contained within the housing, the pin is allowed to retract into the housing against the bias of the upper spring and yet return to its normal position, and extend from the housing with the use of the lower spring, yet return to its normal position, and without causing injury or pain to the customer.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A hair streaking pin comprising:

(a) a pin portion, having a substantially cylindrical elongated body, with a hook portion on a distal end thereof;

(b) a housing having an upper and lower portion, and having an open end on its lower portion, for allowing the hook portion of the pin to extend out from the housing;

(c) first spring means in the lower portion of the housing, for returning the pin to its normal position within the housing after the hook portion of the pin has grasped strands of hair;

(d) second spring means positioned within the upper portion of the housing for returning the pin to its normal position within the housing after the pin has moved inward against the bias of the second spring means when the hook portion has struck a scalp; and (e) means within the housing for preventing rotation of the pin within the housing during the hair streaking process.

2. The apparatus in claim 1, wherein the housing further includes an upper portion which is removable from the lower portion of the housing.

3. The apparatus in claim 1, wherein the pin member further includes a broadened central body portion along its cylindrical length.

4. The apparatus in claim 1, wherein there is further included a stop in the upper portion of the housing for preventing the hook portion of the pin from moving into the housing when the hook strikes the scalp.

5. The apparatus in claim 1, wherein the means for preventing rotation of the pin within the housing further includes a plurality of tab members positioned around an interior surface of a wall of the housing, at the lower portion so that as the pin attempts to rotate within the housing it is obstructed in its rotation by the plurality of tab members.

6. A streaking pin and housing composite apparatus, comprising:

(a) a substantially cylindrical pin member, having a central flared body portion, and a hook on a distal end for grasping strands of hair during streaking;

(b) a housing having a central bore therethrough, the housing further comprising:

(i) a lower portion, having a bore therethrough and a port at its distal end for receiving a lower end of the pin, so that the hook extends out of the bore of the housing;

(ii) a first spring member, positioned between the flared body portion of the pin and the lower end of the housing, so that as the pin moves downward through the bore of the housing against the bias of the first spring member, the first spring member will return the pin to its normal position within the lower portion of the housing;

(iii) an upper portion of the housing, further including a second spring member, positioned between an upper end of the pin and the body portion, the second spring member returning the pin to its normal position after the pin has struck a surface and retracts within the housing; and (c) means within the upper portion of the housing for preventing the pin from retracting fully into the housing.

7. The apparatus in claim 6, further comprising a stop in the upper housing to prevent the pin from retracting fully into the housing.

8. The apparatus in claim 6, wherein the housing is removable into upper and lower portions.

9. The apparatus in claim 6, further comprising means to prevent the pin from rotating within the housing.

10. The apparatus in claim 9, wherein said means to prevent rotating of the pin comprises a stop at a level of the flared body portion of the pin member.

* * * * *